US007428890B2

(12) United States Patent
Lay et al.

(10) Patent No.: US 7,428,890 B2
(45) Date of Patent: Sep. 30, 2008

(54) ON-BOARD FUEL ADDITIVE INJECTION SYSTEMS

(75) Inventors: Mark K. Lay, Houston, TX (US); Chris Schembri, Humble, TX (US); C. Edward Baxter, Jr., League City, TX (US)

(73) Assignee: EnviroFuels LLC, Houston, TX (US)

( * ) Notice: Subject to any disclaimer, the term of this patent is extended or adjusted under 35 U.S.C. 154(b) by 0 days.

(21) Appl. No.: 11/507,776

(22) Filed: Aug. 22, 2006

(65) Prior Publication Data

US 2007/0101969 A1 May 10, 2007

(51) Int. Cl.
*F02B 77/04* (2006.01)
*F02B 43/00* (2006.01)

(52) U.S. Cl. ..... 123/198 A; 123/1 A

(58) Field of Classification Search ..... 123/1 A, 123/198 A

See application file for complete search history.

(56) References Cited

U.S. PATENT DOCUMENTS 4,161,160 A 7/1979 Hicks et al.
4,253,436 A 3/1981 Dudrey
4,557,221 A * 12/1985 Kamel et al. ..... 123/1 A
4,596,277 A * 6/1986 Djordjevic ..... 123/1 A
4,662,327 A * 5/1987 Sprugel et al. ..... 123/1 A
5,404,841 A * 4/1995 Valentine ..... 123/1 A
5,421,295 A * 6/1995 Lemaire et al. ..... 123/1 A
6,068,672 A * 5/2000 Watson et al. ..... 123/1 A
6,252,499 B1 * 6/2001 Gerdtz et al. ..... 340/450.2
6,276,310 B1 * 8/2001 Backes et al. ..... 123/1 A
6,321,692 B1 * 11/2001 Rayner ..... 123/1 A

FOREIGN PATENT DOCUMENTS

DE 10 05 321 B 3/1957
DE 44 45 980 A1 7/1996

* cited by examiner

*Primary Examiner*—Noah Kamen
(74) *Attorney, Agent, or Firm*—Bracewell & Giuliani LLP

(57) ABSTRACT

Disclosed is a fuel additive system for internal combustion engines in which the fuel additive system is disposed on-board a vessel such as marine vessel or locomotive. The fuel additive system includes a fuel additive reservoir containing a fuel additive in fluid communication with an internal combustion engine. An electronically controlled injector, such as an eductor, is in fluid communication with the internal combustion engine and a fuel level meter or sensor, fuel efficiency meter or sensor, or other meter or sensor which, upon sensing certain pre-set conditions, e.g., increase of fuel level in a fuel storage tank or decrease in fuel efficiency, the injector injects an appropriate amount of fuel additive from the fuel additive reservoir and into the fuel stream that ultimately enters the internal combustion engine.

14 Claims, 1 Drawing Sheet

ON-BOARD FUEL ADDITIVE INJECTION SYSTEMS

BACKGROUND

1. Field of the Invention

The present invention relates to improved devices for on-board addition of performance additives to fuel systems of internal combustion ("IC") engines.

2. Description of Related Art

Fuel performance additives are well known for the treatment of engine fuels. The additives can be designed to improve the chemical properties of the fuel such as reducing oxidation, improving stability, reducing corrosivity, lowering pour point, lowering cloud point and eliminating or reducing biological degradation. Fuel additives can also be used to improve the performance properties of the fuel leading to reduction in emissions, increased fuel economy and improved combustion efficiency. The term fuel additives can include single additives, multiple additives and/or additive packages.

It is desirable that the concentration of the additives, depending on desired performance, be maintained in close and critical range. Additive levels in excess of the critical range can be detrimental, especially with respect to the possible formation of sludge, varnishes, gums, and other potentially hazardous substances that can reduce the performance of the engine and can even harm the engine itself. High treatment levels are also non-economical.

Additive levels less than the critical treatment amount can result in lack of engine performance leading, among other things, to fuel degradation and possibly even engine damage. Poor engine operation can also be non-economical.

Currently, fuel additives are typically added to the fuel at large fuel terminals to bulk storage tanks, tank trucks, rail cars or other storage receptacles. The fuel is added by a process known as "splash blending" which means the additives are added as the fuel is being loaded into the receptacle. The process relies on the splashing of the liquids to effect mixing.

Splash blending can also be used to mix the additive with the fuel at on-site tanks. In this case the additive is added to, for example, a bulk fuel tank or bunker tank located at the site of end-use. The splashing of the liquids mixes the additives as the tank is being filled from a fuel distribution vehicle or pipeline. Fuel distribution vehicles can include trucks, rail cars, barges or the like.

Splash blending can similarly be used to additize fuel in on-board bulk tanks or in on-board direct use tanks. The term "on-board" refers to a location on a vessel being driven by the IC engine using the additized fuel. Suitable vessels can include, but are not limited to, railroad locomotives and various marine vessels such as tug boats and barges. The term "direct use tank" refers to the fuel tank that directly feeds the IC engine.

Splash blending is convenient and requires very little capital investment to implement but has several major disadvantages. For one, there is little or no control over the actual mixing process. Lack of positive mixing control could lead to low or otherwise improper additive concentrations. Improper additive concentrations can result in engine damage. Also, there is little or no flexibility to vary additive concentrations to possibly optimize fuel performance. Once the bulk fuel has been additized it would be very difficult to increase the additive concentration. It would be difficult for the additive to mix in with the fuel other than possibly through normal diffusion which is a lengthy and unreliable process. Further, the only way to reduce the additive concentration would be to further dilute the additized tank with more fuel. This also would not be practical.

Also, the additized fuel may not be available in remote locations. This is particularly applicable, for example, in the operation of locomotives and marine vessels. It is possible, and even likely, that refueling may be required in locations and areas where the additive or additized fuel is not available. Additized fuel stored for extended periods of time can degrade, become unstable or otherwise lose effectiveness. There is no way, other than actual chemical analysis, to assure efficacy or concentrations of the pre-additized fuel or additized fuel stored in bulk tanks. Furthermore, continuous chemical analysis is not practical or economical.

Bulk fuel blending methods, other than splash blending, have been and are continuing to be used in industry. Although some fuel blending techniques, such as the utilization of mechanical and in-line agitation, are improvements in mixing control over splash blending, they still suffer much of the other splash blending disadvantages listed above.

Therefore, an improved system and method to enhance the quality and performance of fuel used in IC engines, particularly on board locomotives and marine vessels, is needed. This improved system should preferably include the addition of chemical and performance enhancing additives to the fuel in a manner that is highly accurate, is highly flexible, especially with respect to the ability to vary additive concentrations, can deliver the fuel additives on demand, provide a positive verification of efficacy, and is available in all locations.

SUMMARY OF THE INVENTION

In one aspect, one or more of the foregoing advantages have been achieved through one embodiment of the present fuel additive system for an internal combustion engine on-board a vessel, the system comprising: an internal combustion engine in fluid communication with a fuel storage tank through a fuel supply line and a fuel return line, the fuel supply line transporting fuel from the fuel storage tank to the internal combustion engine and the fuel return line transporting unspent fuel from the internal combustion engine to the fuel storage tank; a reservoir for storing a fuel additive, the reservoir being in fluid communication with the internal combustion engine; and an injector for injecting the fuel additive into the internal combustion engine, the injector being in fluid communication with the reservoir and the internal combustion engine, wherein the internal combustion engine, the reservoir, and the injector are disposed on-board the vessel.

A further feature of the fuel additive system is that the vessel can be a marine vessel. Another feature of the fuel additive system is that the vessel can be a locomotive. An additional feature of the fuel additive system is that the injector can be a venturi siphon pump. Still another feature of the fuel additive system is that the reservoir containing the fuel additive can be in fluid communication with the fuel supply line disposed between the internal combustion engine and the fuel storage tank. A further feature of the fuel additive system is that the internal combustion engine can be in fluid communication with a fuel return line, the fuel return line transporting unspent fuel from the internal combustion engine to the fuel storage tank. Another feature of the fuel additive system is that the reservoir containing the fuel additive can be in fluid communication with the fuel return line disposed between the internal combustion engine and the fuel storage tank. An additional feature of the fuel additive system is that the reservoir containing the fuel additive can be in fluid communication with the fuel storage tank. Still another feature of the fuel additive system is that the fuel storage tank can include a flow meter for measuring the flow of fuel from an outside source into the fuel storage tank. A further feature of the fuel additive system is that the injector can be coupled to the flow meter such that an appropriate amount of the fuel additive is automatically injected into the internal combustion engine upon the flow meter sensing an increase in the level of fuel in the fuel storage tank. Another feature of the fuel additive system is that the reservoir containing the fuel additive can be in fluid communication with the fuel supply line disposed between the internal combustion engine and the fuel storage tank. An additional feature of the fuel additive system is that the internal combustion engine can be in fluid communication with a fuel return line, the fuel return line transporting unspent fuel from the internal combustion engine to the fuel storage tank. Still another feature of the fuel additive system is that the reservoir containing the fuel additive can be in fluid communication with the fuel return line disposed between the internal combustion engine and the fuel storage tank. A further feature of the fuel additive system is that the reservoir containing the fuel additive can be in fluid communication with the fuel storage tank. Another feature of the fuel additive system is that the fuel additive system can further comprise a fuel efficiency meter coupled to the injector such that an appropriate amount of the fuel additive is automatically injected into the internal combustion engine upon the fuel efficiency meter sensing a decrease in the fuel efficiency of the internal combustion engine.

In another aspect, one or more of the foregoing advantages also have been achieved through one embodiment of the present method of injecting a fuel additive into an internal combustion engine of a vessel. The method comprises the steps of: (a) providing a vessel having disposed thereon an internal combustion engine in fluid communication with a fuel storage tank through a fuel supply line, the fuel supply line transporting fuel from the fuel storage tank to the internal combustion engine, a reservoir for storing a fuel additive, the reservoir being in fluid communication with the internal combustion engine, and an injector for injecting the fuel additive into the internal combustion engine; (b) monitoring the level of fuel in the fuel storage tank; (c) sensing an increase in the level of fuel in the fuel storage tank; and (d) injecting an appropriate amount of a fuel additive based upon the increase in the level of fuel in the fuel storage tank.

A further feature of the method of injecting a fuel additive into an internal combustion engine of a vessel is that the internal combustion engine can be in fluid communication with a fuel return line, the fuel return line transporting unspent fuel from the internal combustion engine to the fuel storage tank, and the fuel additive can be injected into the fuel return line. Another feature of the method of injecting a fuel additive into an internal combustion engine of a vessel is that the fuel additive can be injected into the fuel supply line. An additional feature of the method of injecting a fuel additive into an internal combustion engine of a vessel is that the fuel additive can be injected into the fuel storage tank.

The improved systems and methods to enhance the quality and performance of fuel used in IC engines, particularly on board locomotives and marine vessels, have the advantages of: including the addition of chemical and performance enhancing additives to the fuel in a manner that is highly accurate, is highly flexible, especially with respect to the ability to vary additive concentrations; delivering the fuel additives on demand; providing a positive verification of efficacy; and being available in all locations.

DETAILED DESCRIPTION OF THE INVENTION

Figure 1:
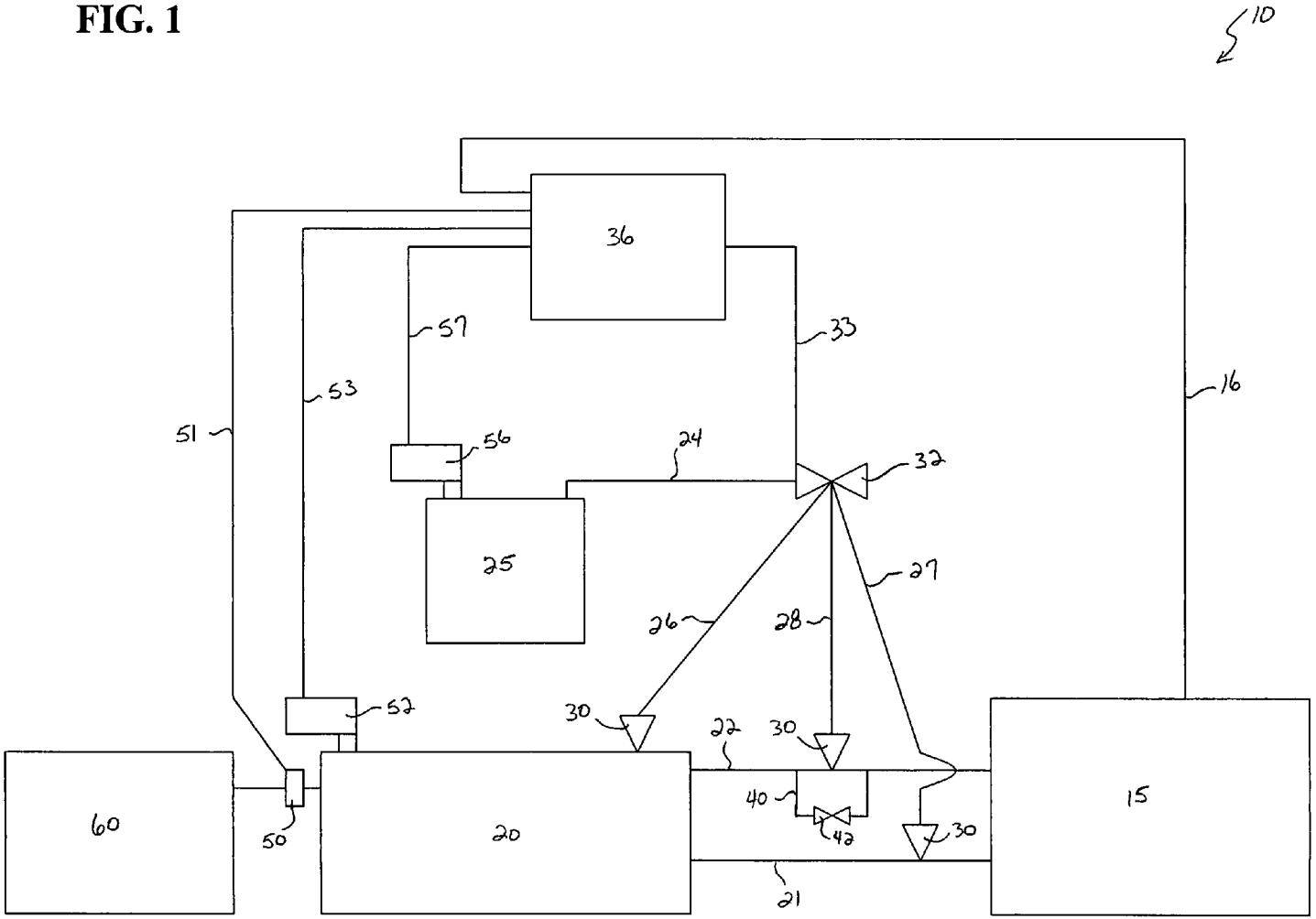
FIG. 1 is a process flow diagram of one specific embodiment of an on-board fuel additive system in accordance with one aspect of the present invention.

Referring now to FIG. 1, one specific embodiment of the fuel additive system of a vessel is disclosed. Broadly, fuel additive system 10 includes internal combustion engine 15, fuel storage tank 20, and fuel additive reservoir 25. Internal combustion engine 15 is in fluid communication with fuel storage tank 20 by fuel supply line 21 and, preferably fuel return line 22. As persons of ordinary skill in the art will recognize, certain internal combustion engines 15, such as those utilized in marine vessels and locomotives, do not burn all of the fuel that enters internal combustion engine 15. Accordingly, such internal combustion engines 15 include fuel return line 22 to transport unburned, or unspent, fuel back to the fuel storage tank 20.

Fuel additive reservoir 25 is in fluid communication with one, two, or all three of fuel storage tank 20 (through injection line 26), fuel supply line 21 (thorough injection line 27), and/or fuel return line 22 (through injection line 28) to facilitate injection of the fuel additive (not shown) into internal combustion engine 15. In one embodiment, in which fuel additive system 10 is treating the fuel flowing directly from fuel storage tank 20 and, thus, feeding internal combustion engine 15, fuel additive system 10 can be interlocked to the engine ignition (not shown) or other type starting system of the vessel such that the internal combustion engine can not be started unless the on-board fuel additive system 10 is energized.

Persons of ordinary skill in the art can readily determine the best and most efficient set-up for injecting the fuel additive into internal combustion engine 15. Preferably, fuel additive reservoir 25 is in fluid communication with fuel supply line 27 and, more preferably, in fluid communication with fuel return line 28. Additionally, fuel additive reservoir 25 preferably includes a drain (not shown) so that residual fuel additive can be removed from fuel additive reservoir 25 such as when the type of fuel additive is to be changed or when the residual fuel additive become old and less effective.

Injector 30, such as an eductor or a metering pump, is preferably in fluid communication with fuel additive reservoir 25 and one or more of fuel storage tank 20 (through injection line 26), fuel supply line 21 (thorough injection line 27), and/or fuel return line 22 (through injection line 28) to facilitate injection of the appropriate amount of fuel additive into internal combustion engine 15. In one specific embodiment, bypass fuel line 40 and bypass valve 42 are included in fuel additive system 10 so that fuel flow will not be blocked or restricted in the event that injector 30 becomes inoperable or blocked.

In the embodiment in which injector 30 is in fluid communication with fuel supply line 21 and/or fuel return line 22, injector 30 preferably is adjustable such that flow of fuel additive through injector 30 can be adjusted in relation to the fuel flowing through fuel supply line 21 and/or fuel return line 22.

Also disposed in fluid communication with injector 30 and fuel additive reservoir 25 is valve 32. Valve is in fluid communication with fuel additive reservoir 25 by fuel additive line 24. Valve 32 controls the flow of fuel additive from fuel additive reservoir 25, through injector 30 and, thus, into internal combustion engine 15. Valve 32 may also be a backpressure regulator.

Valve 32 is coupled to CPU 36 by coupling line 33, e.g., electric wiring. CPU 36 operates valve 32 by instructing valve 32 to open or close, thereby controlling injection of the amount or volume of fuel additive being injected into internal combustion engine 15. Preferably, CPU 36 is capable of monitoring the volume of flow of fuel additive through injector 30, including the total amount of fuel additive flow over any period of time of interest. Additionally, CPI 36 is also preferably capable of storing or recording the flow data such that the fuel additive flow at any given point of time, and the total flow of fuel additive at any given point of time.

In one specific embodiment, CPU 36 is coupled to fuel storage tank flow meter 50 by line 51 and/or to fuel storage tank sensor 52 by line 53. In one embodiment, fuel storage tank flow meter 50 can be coupled to sensor 52. Thus, as fuel from outside source 60 is pumped into fuel storage tank 20, the amount of fuel entering fuel storage tank 20 is measured by one or both of fuel storage tank flow meter 50 or fuel storage tank sensor 52. One or both of these measurements will be communicated from fuel storage tank flow meter 50 and/or fuel storage tank sensor 52 to CPU 36 by their respective line couplings 51 or 53. Subsequently, CPU 36, determines, based upon the level of fuel in fuel storage tank 20, or based upon the amount of fuel pumped into fuel storage tank 20, the appropriate amount of fuel additive that is to be injected from fuel additive reservoir 25 into internal combustion engine 15. The appropriate amount of fuel additive is determined by the CPU based upon the desired or necessary ratio of fuel to fuel additive to optimize fuel efficiency or some other desired operating parameter, e.g., horsepower, of internal combustion engine 15. CPU 36 then actuates valve 32 and the appropriate amount of fuel additive that is injected from fuel additive reservoir 25 into internal combustion engine 15. Suitable injectors 30, flow meters 50, and fuel storage tank sensors 52 are all known in the art.

In one specific embodiment, valve 32 includes in fluid communication therewith a flow meter (not shown) so that the flow of fuel additive from fuel additive reservoir 25 into internal combustion engine 15 can be measured and monitored by CPU 36. Alternatively, fuel additive reservoir 25 can include a fuel additive level sensor 56 which is coupled to CPU 36 by line 57. Thus, CPU 36 can monitor and record the level of fuel additive contained in fuel additive reservoir 25 through fuel additive level sensor 29.

In another embodiment, CPU 36 is in communication with internal combustion engine 15 by line coupling 16. In this embodiment, CPU 36 measures one or more parameters of the performance of internal combustion engine 15 such as throttle notch, speed, engine output, traction motor current, and reverser position. CPU 36 can also monitor fuel consumption based upon the flow of fuel through flow meter disposed on both fuel supply line 21 and fuel return line 22. Further, CPU 36 can be programmed to account for parasitic loads such as cooling fans and calculate vessel horsepower output.

The data observed and recorded by CPU 36 of internal combustion engine 15 allows CPU 36 to calculate brake-specific fuel consumption in gallons per horsepower-hour of internal combustion engine 15 in each throttle notch. This metric captures the true fuel efficiency of internal combustion engine 15, regardless of mode of operation, e.g., switching or line-haul in the case of locomotives, terrain or ocean heave, temperature, gross-ton miles and carloads (in the case of locomotives), nautical miles and container loads (in the case of marine vessels), or passenger miles.

By monitoring, recording, and reporting fuel efficiency, CPU 36 can determine whether the fuel efficiency of internal combustion engine 15 can be increased. If so, CPU 36 actuates valve 32 so that the appropriate amount of fuel additive can be injected from fuel additive reservoir 25 into internal combustion engine 15.

In a preferred embodiment, the vessel (not shown) includes a GPS tracking device (not shown) and a wireless uplink (not shown). The wireless uplink is coupled to injector 30, flow meter 50, sensor 52, and fuel efficiency meter 70. Accordingly, the location of the vessel and the fuel burn rate, fuel efficiency and other parameters of internal combustion engine 15 can be monitored remotely from the vessel. As a result, internal combustion engine 15 can be monitored for optimum fuel efficiency and for compliance with rules and regulations directed to appropriate and sufficient amounts of fuel additive being included in the fuel. It is also believed that fuel additive system 10 can be controlled by wireless connection as well. Therefore, CPU 36 can be overridden by a controller located remotely from the vessel. Such a situation can arise where the CPU 36 does not recognize a need to inject additional fuel additive, however, an operator believe such an injection may be beneficial.

CPU 36 can be any computer or microprocessor device known in the art. Likewise, the software utilized by CPU 36 to perform the various functions described herein can be obtained from third party vendors or prepared by computer programmers without undue experimentation. In a preferred embodiment, CPU 36 is Wi-Tronix WI PU 635-CG, with accompanying software, available from Wi-Tronix, LLC of Bolingbrook, Ill.

Advantages of the fuel additive systems disclosed herein include: providing a highly accurate delivery of the fuel additives directly into a flowing fuel line; providing treatment of the fuel on demand; that is, the fuel is treated only as it is used; providing a positive indication of the treat rate which is directly proportional to the concentration of the additives in the fuel; permitting fuel additive to be injected directly into the flowing fuel stream; and providing a fuel additive system located on-board the railroad locomotive or marine vessel or other suitable vessel or vehicle such that the fuel treatment can occur continuously and in all locations.

Other advantages of the fuel additive systems disclosed herein include the capability of adjusting the concentration of the fuel additives using the CPU, essentially instantaneously, in order to optimize the fuel additive concentration and maximize the benefits and performance of the fuel additive.

The fuel additive system can be used to treat any flowing fuel stream in which addition of the fuel additive is desired. As discussed above, the flowing fuel stream may be the fuel being loaded into an on-board storage tank or receptacle. Alternatively, the flowing fuel stream may be the fuel directly feeding the internal combustion engine.

The fuel additive injection system can be on-board any mobile vessel, vehicle or device such that injection system can additize any on-board flowing fuel stream. In a preferred embodiment of the present invention the fuel additive injection system is located on-board a railroad locomotive. In another preferred embodiment of the present invention the fuel additive injection system is located on-board a marine vessel.

It is to be understood that the invention is not limited to the exact details of construction, operation, exact materials, or embodiments shown and described, as modifications and equivalents will be apparent to one skilled in the art. For example, the fuel additive system can be used with any fuel additive desired; although, preferably, the fuel additive is the phosphate salt containing additives disclosed in U.S. patent application Publication No. 2005/0028434, which is incorporated herein in its entirety. Moreover, the size and shape of the fuel additive reservoir may be any shape or size desired or necessary to dispose the fuel additive reservoir on-board the vessel. In a preferred embodiment, the fuel additive reservoir is capable of holding at least 75 gallons. Accordingly, the invention is therefore to be limited only by the scope of the appended claims.

What is claimed is:

1. A fuel additive system for an internal combustion engine on-board a vessel, the system comprising:

an internal combustion engine in fluid communication with a fuel storage tank through a fuel supply line and a fuel return line, the fuel storage tank includes a flow meter for measuring the flow of fuel from an outside source into the fuel storage tank, the fuel supply line transporting fuel from the fuel storage tank to the internal combustion engine and the fuel return line transporting unspent fuel from the internal combustion engine to the fuel storage tank;

a reservoir for storing a fuel additive, the reservoir being in fluid communication with the internal combustion engine, wherein the reservoir for storing the fuel additive is in fluid communication with the fuel supply line disposed between the internal combustion engine and the fuel storage tank; and an injector for injecting the fuel additive into the internal combustion engine, the injector being in fluid communication with the reservoir and the internal combustion engine, wherein the internal combustion engine, the reservoir, and the injector are disposed on-board the vessel wherein the injector is coupled to the flow meter such that an appropriate amount of the fuel additive is automatically injected into the internal combustion engine upon the flow meter sensing an increase in the level of fuel in the fuel storage tank.

2. The fuel additive system of claim 1, wherein the vessel is a marine vessel.

3. The fuel additive system of claim 1, wherein the vessel is a locomotive.

4. The fuel additive system of claim 1, wherein the injector is a venturi siphon pump.

5. The fuel additive system of claim 1, wherein the internal combustion engine is in fluid communication with a fuel return line, the fuel return line transporting unspent fuel from the internal combustion engine to the fuel storage tank.

6. The fuel additive system of claim 5, wherein the reservoir containing the fuel additive is in fluid communication with the fuel return line disposed between the internal combustion engine and the fuel storage tank.

7. The fuel additive system of claim 1, wherein the reservoir containing the fuel additive is in fluid communication with the fuel storage tank.

8. The fuel additive system of claim 1, wherein the reservoir containing the fuel additive is in fluid communication with the fuel supply line disposed between the internal combustion engine and the fuel storage tank.

9. The fuel additive system of claim 1, wherein the internal combustion engine is in fluid communication with a fuel return line, the fuel return line transporting unspent fuel from the internal combustion engine to the fuel storage tank.

10. The fuel additive system of claim 9, wherein the reservoir containing the fuel additive is in fluid communication with the fuel return line disposed between the internal combustion engine and the fuel storage tank.

11. The fuel additive system of claim 1, wherein the reservoir containing the fuel additive is in fluid communication with the fuel storage tank.

12. A fuel additive system for an internal combustion engine on-board a vessel, the system comprising:

an internal combustion engine in fluid communication with a fuel storage tank through a fuel supply line and a fuel return line, the fuel supply line transporting fuel from the fuel storage tank to the internal combustion engine and the fuel return line transporting unspent fuel from the internal combustion engine to the fuel storage tank;

a reservoir for storing a fuel additive, the reservoir being in fluid communication with the internal combustion engine, wherein the reservoir for storing the fuel additive is in fluid communication with the fuel supply line disposed between the internal combustion engine and the fuel storage tank;

an injector for injecting the fuel additive into the internal combustion engine, the injector being in fluid communication with the reservoir and the internal combustion engine, wherein the internal combustion engine, the reservoir, and the injector are disposed on-board the vessel; and a fuel efficiency meter coupled to the injector such that an appropriate amount of the fuel additive is automatically injected into the internal combustion engine upon the fuel efficiency meter sensing a decrease in the fuel efficiency of the internal combustion engine.

13. A method of injecting a fuel additive into an internal combustion engine of a vessel, the method comprising the steps of:

(a) providing a vessel having disposed thereon an internal combustion engine in fluid communication with a fuel storage tank through a fuel supply line, the fuel supply line transporting fuel from the fuel storage tank to the internal combustion engine, a reservoir for storing a fuel additive, the reservoir being in fluid communication with the internal combustion engine, and an injector for injecting the fuel additive into the fuel supply line;

(b) monitoring the level of fuel in the fuel storage tank;

(c) sensing an increase in the level of fuel in the fuel storage tank; and (d) injecting an appropriate amount of a fuel additive based upon the increase in the level of fuel in the fuel storage tank.

14. The method of claim 13, wherein the internal combustion engine is in fluid communication with a fuel return line, the fuel return line transporting unspent fuel from the internal combustion engine to the fuel storage tank, and the fuel additive is injected into the fuel return line.

* * * * *